US005740864A

United States Patent [19]

de Hoedt et al.

[11] Patent Number: 5,740,864

[45] Date of Patent: Apr. 21, 1998

[54] ONE-TRIP PACKER SETTING AND WHIPSTOCK-ORIENTING METHOD AND APPARATUS

[75] Inventors: Bernard de Hoedt, Celle, Germany; Jelle Wielenga, Ümiden, Netherlands

[73] Assignee: Baker Hughes Incorporated, Houtson, Tex.

[21] Appl. No.: 593,729

[22] Filed: Jan. 29, 1996

[51] Int. Cl.[6] ..... E21B 7/08

[52] U.S. Cl. ..... 166/387; 166/117.5

[58] Field of Search ..... 166/117.6, 113, 166/382, 117.5, 387

[56] References Cited

U.S. PATENT DOCUMENTS

| | | | |
|---|---|---|---|
| 3,908,759 | 9/1975 | Cagle et al. . | |
| 4,153,109 | 5/1979 | Szescila . | |
| 4,285,399 | 8/1981 | Holland et al. | 166/113 |
| 4,304,299 | 12/1981 | Holland et al. | 166/255.3 |
| 4,307,780 | 12/1981 | Curington | 166/113 |
| 4,397,355 | 8/1983 | McLamore . | |
| 4,765,404 | 8/1988 | Bailey et al. . | |
| 5,012,877 | 5/1991 | Winters et al. | 175/80 |
| 5,109,924 | 5/1992 | Jurgens et al. . | |
| 5,154,231 | 10/1992 | Bailey et al. . | |
| 5,193,620 | 3/1993 | Braddick . | |
| 5,195,591 | 3/1993 | Blount et al. . | |
| 5,287,921 | 2/1994 | Blount et al. . | |
| 5,335,737 | 8/1994 | Baugh . | |
| 5,341,873 | 8/1994 | Carter et al. . | |
| 5,377,251 | 12/1994 | Blount et al. . | |
| 5,398,754 | 3/1995 | Dinhoble . | |
| 5,409,060 | 4/1995 | Carter | 166/237 |
| 5,425,417 | 6/1995 | Carter | 166/117.6 |
| 5,427,179 | 6/1995 | Bailey et al. . | |
| 5,429,187 | 7/1995 | Beagrie et al. . | |
| 5,431,219 | 7/1995 | Leising et al. | 166/50 |
| 5,431,220 | 7/1995 | Lennon et al. . | |
| 5,437,340 | 8/1995 | Lee et al. . | |
| 5,443,129 | 8/1995 | Bailey et al. . | |
| 5,445,222 | 8/1995 | Pritchard et al. . | |
| 5,488,989 | 2/1996 | Leising et al. | 166/255.3 |
| 5,592,991 | 1/1997 | Lembcke et al. . | |

FOREIGN PATENT DOCUMENTS

| | | |
|---|---|---|
| 2258479 | 2/1993 | United Kingdom . |
| 2291448 | 1/1996 | United Kingdom . |
| WO 94/09243 | 4/1994 | WIPO . |
| WO 95/23274 | 8/1995 | WIPO . |

OTHER PUBLICATIONS

Baker Oil Tools, Production Report, Window Master, 3 pages, 1995.

Hart's Petroleum Engineer International, p. 13, 1997.

A–Z/Grant International, Casing Sidetrack Systems, date unknown.

Baker Oil Tools, Permanent Packer Systems, Model "D" and DB Retainer Production Packer, date unknown.

Baker Oil Tools, Permanent Packer Systems, Electric Wireline Packer Setting, Model "E–4" Wireline Pressure Setting Assembly, Model L Hi–Temp Wireline Pressure Setting Assembly, date unknown.

Baker Oil Tools, Permanent Packer Systems, Model "BH" Setting Tool, Model BHH Setting Tool, date unknown.

Baker Oil Tools, Permanent Packer Systems, Model "DW–1" Whipstock Packer, Model W–2 Whipstock Anchor Assembly, date unknown.

The Red Baron Whipstock, Single Trip Side Track System Technical Specification, date unknown.

Computalog, Wireline Products Catalog, 1991, 28 pages.

Baker Hughes Inteq, Seeker Surveying System, Technical Data Sheet, Jan. 1994, 2 pages.

*Primary Examiner*—Frank Tsay

*Attorney, Agent, or Firm*—Rosenblatt & Redano P.C.

[57] ABSTRACT

A method and apparatus is disclosed which allows running in a whipstock packer in combination with a setting assembly, which also includes instrumentation to sense the depth, as well as orientation of the anchor orientation groove on the packer. The packer can be run in the hole on wireline and when the proper depth is reached the sensed and a signal from the surface sets the setting tool into motion to set the packer with the whipstock anchor groove in proper orientation. The whipstock, along with a mill and the anchor are then run in and latched into the anchor groove on the packer on a second trip and milling through a casing begins.

16 Claims, 3 Drawing Sheets

ONE-TRIP PACKER SETTING AND WHIPSTOCK-ORIENTING METHOD AND APPARATUS

FIELD OF THE INVENTION

The field of this invention relates to techniques for setting and measuring orientation of a key for a whipstock anchor in a single trip into the well.

BACKGROUND OF THE INVENTION

Whipstocks are deviation devices that are used downhole to orient a mill to mill a lateral opening in a casing so that an offset wellbore can be drilled to enhance further production from a given formation. Typically, whipstocks are supported on packers or plugs. Procedures to accomplish the milling of the deviated wellbore by use of a whipstock have involved numerous trips into and out of the wellbore. Typically, the well is initially logged with a measuring device such as a casing collar locator (CCL) to determine the depth where the packer will be set. After logging the well, the packer is then run on drillpipe and hydraulically set. A gyroscopic orientation tool on electric wireline is then run in the well to measure the orientation of the anchor, which is on top of the packer, which has already been set. Depending on the readings from the gyroscopic orientation tool, an adjustment can be made to the position of the whipstock anchor. This adjustment may yet require another trip in the hole. Finally, with the anchor properly adjusted, the whipstock is run in and secured to the anchor and milling begins. The orientation of the whipstock can be checked after it is set into the anchor to ensure that no changes to the orientation have occurred in the setting process.

It can be seen that there were numerous trips required to complete this procedure. At least one trip was used to properly locate the depth at which the packer was to be set, followed by setting the packer. Another trip was then required to get the orientation of the anchor determined, with yet another trip potentially required to run the whipstock in the hole and latch it into the anchor.

This fragmented procedure may have resulted from the traditional divisions among oilfield service companies. In the past, an oil tool company was responsible for packer placement, while a measurement company would be involved in the orientation of the anchor. Now, with oilfield service companies becoming more integrated, distinct groups have started working together to streamline operations, resulting in the present invention.

The apparatus and method of the present invention have as their objective a streamlining technique and equipment therefor to reduce the number of trips required to accomplish the proper positioning of a whipstock so that milling can begin through a casing. The depth-measuring instrumentation is combined with the orientation instrumentation in an assembly involving a setting tool. This combination in turn allows the packer to be properly located at the appropriate depth and its orientation determined by the use of the gyroscopic orientation tool. With the orientation of the packer slot for the anchor determined, the whipstock is oriented to the anchor at the surface. When that assembly of the whipstock and anchor is run in, such as on coiled tubing, and set into the anchor keyway in the packer, the whipstock is properly oriented.

SUMMARY OF THE INVENTION

A method and apparatus is disclosed which allows running in a whipstock packer in combination with a setting assembly, which also includes instrumentation to sense the depth, as well as orientation, of the anchor orientation groove on the packer. The packer can be run in the hole on wireline and when the proper depth is reached, the orientation is sensed and a signal from the surface sets the setting tool into motion to set the packer with the whipstock anchor groove in proper orientation. The whipstock, along with a mill and the anchor, are then run in and latched into the anchor groove on the packer on a second trip and milling through a casing begins.

DETAILED DESCRIPTION OF THE PREFERRED EMBODIMENT

Figure 1:
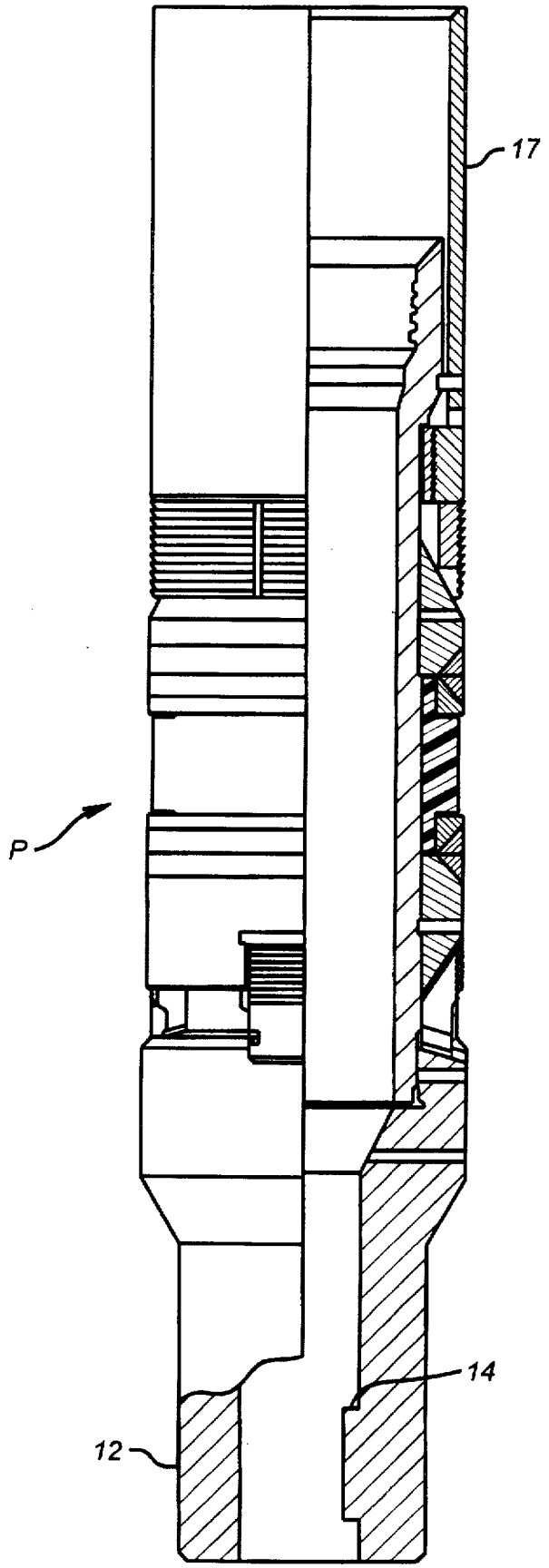
FIG. 1 is a sectional elevational assembly of a packer, illustrating the anchor groove for the whipstock anchor.
Figure 4:
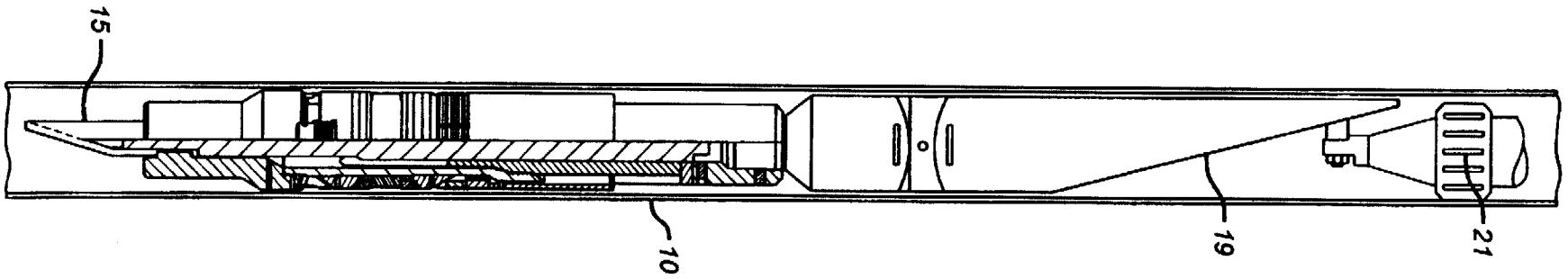
FIG. 4 is the assembly with the whipstock and anchor set into the orientation groove in the packer.

As shown in FIG. 1, a packer P of known construction is to be set in a casing 10 (see FIG. 4 for illustration with casing). At the bottom end 12 is an anchor orientation groove or key 14, which is also of a type well-known in the art. In the preferred embodiment, a Baker Oil Tools DW-1 whipstock anchor and packer assembly is used for the assembly shown in FIG. 1. The groove 14 is designed to accept a whipstock anchor 15 (see FIG. 4) which can only fit into the groove 14 in one orientation.

Figure 2:
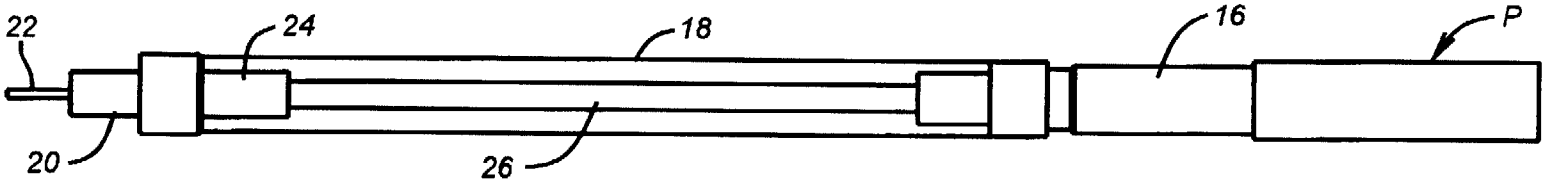
FIG. 2 is a schematic assembly of the components, illustrating how a wireline-set packer, in combination with the equipment to determine depth and orientation, can be run in the hole with one trip and set when properly oriented.

FIG. 2 illustrates the packer P to which is attached a wireline pressure-setting tool, such as the Baker Oil Tools Model E-4. This setting tool is generally referred to as 16. A carrier assembly 18 physically connects the instrumentation package to a power control sub 20. The power control sub 20 is connected to the surface via a wireline 22. Located in the carrier assembly 18 is a casing collar locator (CCL) 24. Those skilled in the art will appreciate that other instrumentation can be used in lieu of a casing collar locator to ascertain the depth of the packer without departing from the spirit of the invention. Other such known measuring tools for depth are gamma ray and resistivity tools. Also included in the carrier assembly 18 is the gyroscopic orientation tool 26, which in the preferred embodiment is offered by Baker Hughes Inteq and known as the Seeker™ Surveying System. However, other types of orientation tools can be used without departing from the spirit of the invention.

The casing collar locator 24 sends real-time readings to the surface as to the depth of the packer. Such signals are processed through the wireline 22. Power to the power control sub 20 also comes from the surface through the wireline 22. Orientation signals on a real-time basis come from the orientation tool 26 back to the surface through wireline 22. Again, the power supply for the gyroscopic tool 26 comes from the surface through wireline 22. The preferred pressure-setting tool 16 is a Baker Hughes Model E-4, which uses electric power to create the requisite mode of pressure force through a reaction which ultimately shifts the setting sleeve 17 (see FIG. 1) on the packer P to set it.

Figure 3:
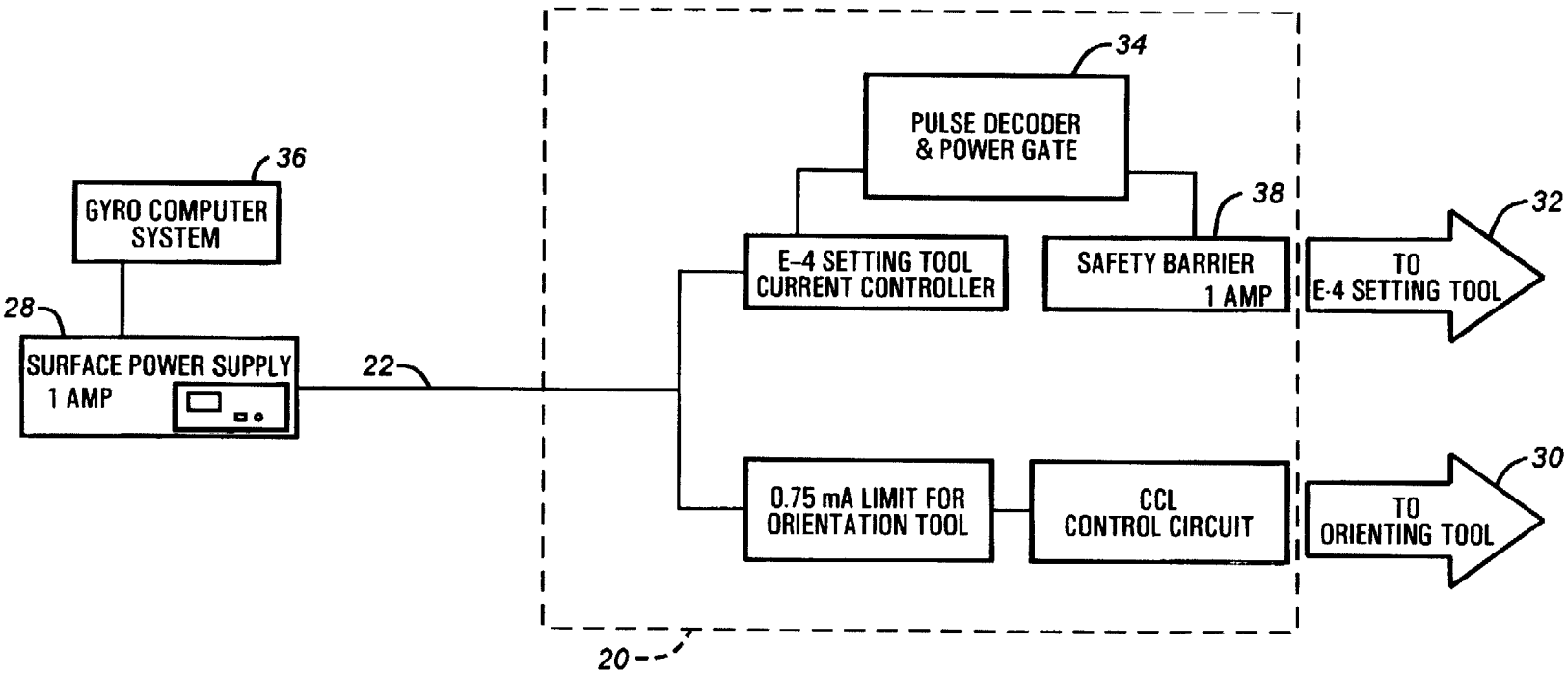
FIG. 3 is a schematic representation of the controls involved to allow setting of the packer only upon the giving of a predetermined signal from the surface after proper orientation has been accomplished.

FIG. 3 illustrates in a schematic way the features in the controls to ensure that the packer P is not set until the appropriate readings on the gyroscopic tool 26 are obtained. As seen in FIG. 3, a surface power supply 28 is connected through wireline 22 to the control circuitry going to the gyroscopic tool 26 (see arrow 30), as well as to the setting tool 16 (see arrow 32).

In the circuitry leading to arrow 32 is a pulse decoder 34. When a predetermined array of signals is generated at the power supply 28, such signals are interpreted by the pulse decoder to dose a gate to allow current to reach the setting tool 16 through a one-amp safety barrier 38. The ignitor on the setting tool 16, when the Baker Hughes E-4 setting tool used, can be either a standard ignitor or a high-resistance ignitor. The standard ignitor goes by part number BP-3D437-44-2100 and the high-resistance ignitor goes by part number BP-4437-44-4000. Both of these ignitors use a one-amp power source to fire. To ensure compete operation, the one-amp power level needs to be retained for a period of 10 seconds for the standard ignitor and 30 seconds for the high-resistance ignitor. Since the resistance of the standard ignitor is around 3–5 ohms, a firing voltage of 5 volts is required. With the use of the high-resistance ignitor, there is a resistance of 56 ohms, requiring 56 volts to ensure full ignition. The system shown in FIG. 3 shows that the predetermined code of pulses needs to be detected in the power control sub 20 before the required voltage is transmitted to the setting tool 16.

Those skilled in the art can now appreciate that with the assembly illustrated in FIG. 2 and the control system of FIG. 3, a technique and equipment are disclosed which allow for one-trip running of a packer, during which its depth can be determined and its orientation measured. It is within the scope of the invention to measure orientation downhole in one trip and use other techniques for depth measurement. The preferred embodiment is to do both downhole in the first trip. The casing collar locator or equivalent instrument 24 gives feedback at the surface that the proper depth has been reached for the packer. With power supply from the surface through a wireline, the orientation of the packer anchor groove or key 14 for the whipstock is determined. As the orientation is measured, the necessary coded signals are sent from the surface power supply 28 downhole through the wireline 22. When such signals are properly read by the decoder 34, the power is supplied to the E-4 setting tool or equivalent and the necessary pressure is developed so that the packer P can be set. When the setting tool 16 is actuated, the packer P is set and the setting tool 16 releases from the packer so that the assembly can be retrieved out of the wellbore. Thereafter, a whipstock is run in the traditional manner with anchor 15, with the proper angular offset fixed at the surface so that when anchor 15 latches into key 14, the whipstock 19 will be properly oriented at the right depth. The window mill 21, which is generally run in with the whipstock, is actuated to begin the drilling operation to mill a window in a casing in the known manner.

While one assembly of components has been illustrated, those skilled in the art will appreciate that different types of packers can be used and the assembly can be run into the wellbore, not only on wireline but also on coiled or rigid tubing.

Once the packer P is set and its orientation groove or key has its orientation measured, the first trip is complete, and on a subsequent trip the whipstock 19 is properly oriented when anchor 15 is latched to key 14.

Accordingly, in one trip a packer is run in the hole to a predetermined depth, then it is set and its set orientation measured. This saves the well operator considerable time and expense by accomplishing all of these tasks in one trip, as opposed to the prior techniques involving separate trips to run in and set the packer, followed by another trip to properly measure the orientation of said packer, and yet another trip to run in the whipstock and latch anchor 15 to key 14.

The foregoing disclosure and description of the invention are illustrative and explanatory thereof, and various changes in the size, shape and materials, as well as in the details of the illustrated construction, may be made without departing from the spirit of the invention.

We claim:

1. A method of placement of a whipstock in a wellbore, comprising:

mounting a setting tool to a packer having an orientation key for whipstock anchor thereon;

mounting instrumentation adjacent to said setting tool to indicate depth of the packer;

mounting instrumentation adjacent to said setting tool to determine the orientation of said whipstock anchor orientation key;

running said packer with said setting tool and said depth indicating and orientation sensing instrumentation into the wellbore to a predetermined depth; and obtaining the predetermined depth of said packer and orientation of said whipstock anchor orientation key in one trip; and setting said packer.

2. The method of claim 1, wherein:

providing a control system to prevent setting said packer until a signal is provided from the surface.

3. The method of claim 2, wherein:

providing a signal decoder as part of said instrumentation; and not setting said setting tool until a predetermined pattern of pulses is detected by said decoder.

4. The method of claim 3, wherein:

using a gyroscopic orientation tool as said instrumentation to determine orientation of said whipstock orientation key.

5. The method of claim 4, wherein:

using a casing collar locator as said depth indicating instrumentation.

6. The method of claim 5, wherein:

using a wireline to run in said setting tool.

7. The method of claim 6, wherein:

obtaining a signal at the surface as to the present depth and orientation of said whipstock anchor orientation key.

8. The method of claim 7, wherein:

releasing said depth and orientation instrumentation from said packer after said setting.

9. The method of claim 8, wherein:

orienting an anchor to a whipstock;

running in the anchor and whipstock; and securing said anchor on said whipstock to said whipstock orientation key on said packer.

10. An apparatus for supporting a whipstock in a wellbore, comprising:

a packer having a whipstock anchor orientation groove;

a setting tool releasably secured to said packer;

an orientation instrument supported by said setting tool;

whereupon in a single trip in the wellbore said whipstock anchor orientation groove on said packer can have its orientation measured by said orientation instrument before the packer is set by said setting tool.

11. The apparatus of claim 10, further comprising:

a depth indicating instrument supported by said setting tool to allow depth measurement of said packer and measurement of orientation of its groove in a single trip.

12. The apparatus of claim 11, further comprising:

said setting tool is activated electrically; and a control system supported by said setting tool to prevent power supply to said setting tool until said control system receives a predetermined signal.

13. The apparatus of claim 12, further comprising:

a wireline run from the surface to support said instruments and setting tool with said packer, said wireline transmitting real-time data as to depth and orientation of said whipstock anchor on said packer.

14. The apparatus of claim 13, wherein:

said control system comprises a signal transmitter connected by said wireline to a signal decoder mounted adjacent said setting tool, said decoder interrupting power to said setting tool until it receives said predetermined signal from said transmitter.

15. The apparatus of claim 14, wherein:

said setting tool when energized sets said packer and releases therefrom to allow removal of said setting tool and said instruments from the wellbore.

16. The apparatus of claim 11, further comprising:

a whipstock and anchor whose angular rotation is fixed at the surface so that upon running in when said anchor latches to said orientation groove after the packer is set, said whipstock is properly oriented.

* * * * *